US005794868A

United States Patent [19]

Busenhart et al.

[11] Patent Number: 5,794,868

[45] Date of Patent: Aug. 18, 1998

[54] SPIN WINDING MACHINES

[75] Inventors: Peter Busenhart, Wiesendangen; Kurt Wetter, Hagenbuch, both of Switzerland; Willi Kretzschmar, Grosswallstadt, Germany

[73] Assignee: Maschinenfabrik Rieter AG, Winterthur, Switzerland

[21] Appl. No.: 648,158

[22] PCT Filed: Sep. 21, 1995

[86] PCT No.: PCT/CH95/00211

§ 371 Date: Jul. 22, 1996

§ 102(e) Date: Jul. 22, 1996

[87] PCT Pub. No.: WO96/09425

PCT Pub. Date: Mar. 28, 1996

[30] Foreign Application Priority Data

Sep. 21, 1994 [CH] Switzerland ..... 2863/94

[51] Int. Cl.[6] ..... B65H 54/02

[52] U.S. Cl. ..... 242/35.5 R

[58] Field of Search ..... 242/35.5 R, 42

[56] References Cited

U.S. PATENT DOCUMENTS

| | | | |
|---|---|---|---|
| 2,869,796 | 1/1959 | Konig | 242/35.5 R |
| 3,036,784 | 5/1962 | Schippers et al. | 242/35.5 R |
| 3,279,711 | 10/1966 | Schippers et al. | 242/35.5 R |
| 3,544,017 | 12/1970 | Schippers et al. | 242/18 |
| 3,720,382 | 3/1973 | Lehner . | |
| 3,844,496 | 10/1974 | Rothert | 242/35.5 R |
| 3,862,722 | 1/1975 | Pierce | 242/35.5 R |
| 3,902,833 | 9/1975 | Matovinovic . | |
| 4,043,718 | 8/1977 | Takenaka et al. | 242/35.5 R |
| 4,351,492 | 9/1982 | Aoyama et al. | 242/18 R |
| 4,535,515 | 8/1985 | Baertschi et al. . | |
| 4,566,643 | 1/1986 | Hasegawa et al. | 242/18 R |

FOREIGN PATENT DOCUMENTS

| | | |
|---|---|---|
| 0 080 568 | 3/1988 | European Pat. Off. . |
| 0 539 866 | 5/1993 | European Pat. Off. . |
| 26 33 406 | 1/1978 | Germany . |
| 44 06 995 | 9/1994 | Germany . |
| 273678 | 5/1951 | Switzerland . |

OTHER PUBLICATIONS

Patent Abstracts of Japan, JP 7034316, Publicatoin Date Feb. 3, 1995.

"Chemiefasern/Textilindustrie", Sep. 1991, pp. 1002–, by Fourne, Czase and Mears.

*Primary Examiner*—Michael Mansen

*Attorney, Agent, or Firm*—Burns, Doane, Swecker & Mathis, LLP

[57] ABSTRACT

In an arrangement for spinning endless threads of synthetic filaments an apparatus is provided normally comprising a winder as well as a unit comprising a roll arrangement. Owing to the application of rolls of extended length the design height level of the apparatus above the winder can be reduced substantially.

9 Claims, 7 Drawing Sheets

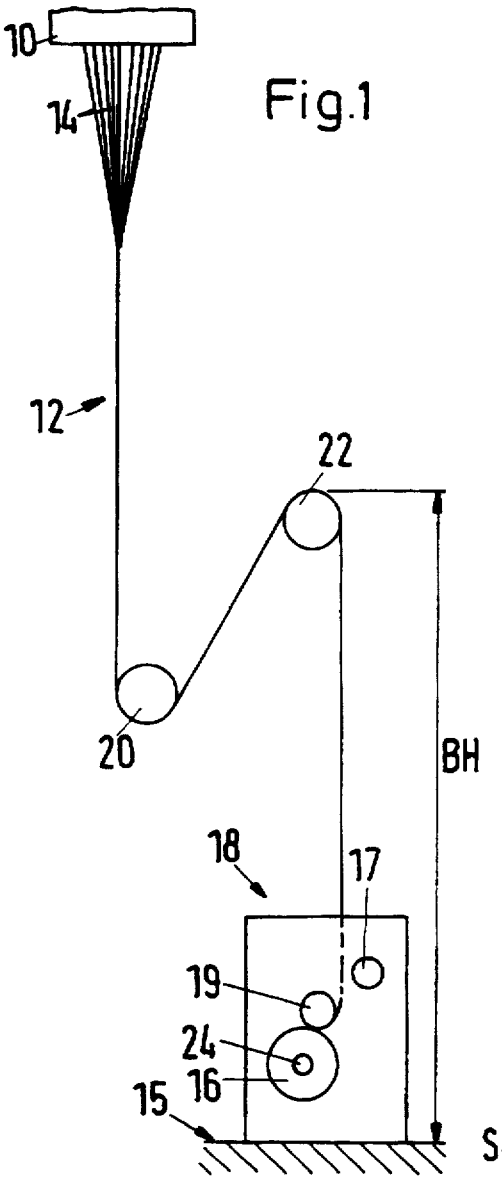
Fig.1
Fig.2
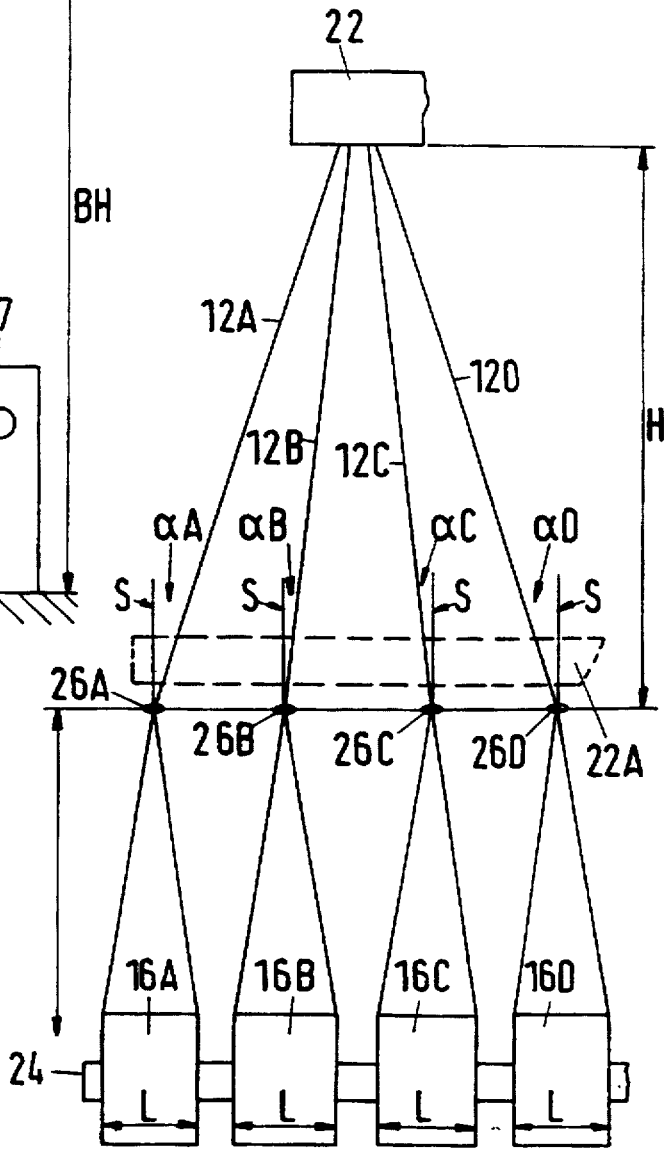

SPIN WINDING MACHINES

BACKGROUND ART

The present invention concerns devices, apparatus and plants for spinning endless threads, in particular of synthetic filaments.

Certain problems in spin winding have been described in the journal "Chemiefaser/Textilindustrie", September 1991, from page 1002 on, in an article by the authors Fourne, Czase and Mears. According to this article rolls are provided to separate the spinneret take-off tension from the winding tension in the thread.

Said publication does not consider, however, the problem of the design height level of the arrangement nor of the operation of the plant. Problems of this nature are not negligible, as stressed in EP-C-80568. These problems are described also in U.S. Pat. No. 4043718 where one thread merely is to be handled. As described in the following in more detail within the scope of the present invention the problems of design height level, or of operating the plant respectively, are aggravated further where a plurality of threads (e.g. more than two threads) are processed on a single spinning position through to the winding process. The operating problems particularly make themselves felt during the threading-in process.

In winding a plurality of threads simultaneously also problems arise concerning the arrangement of the two rolls relative to the row of spinnerets on one hand and relative to the winder on the other hand. These problems have led to most diverse proposals. Thus, the so-called parallel winding method is known in which the guide surfaces (the rolls) extend parallel to the row of spinnerets and to the chuck axis. Examples of arrangements of this type are found in GB 1415947, EP 539866 and DE 4406995. This arrangement proves advantageous as all the threads can be processed under the same conditions. The arrangement is cost-intensive, however, and thus can be applied just in a few isolated cases. The so-called "90°-winding" method proves less cost-intensive, in which arrangement the row of spinnerets is arranged at right angles with respect to the chuck axis. Geometry of the thread path in this arrangement can cause problems.

In connection with the 90°-winding method an arrangement also is known in which the first (take-in) roll is arranged neither parallel nor at right angles with respect to the chuck axis but at an angle as indicated in U.S. Pat. No. 3,862,722. According to U.S. Pat. No. 3,544,017 the first roll is to be arranged at right angles and the second roll parallel with respect to the chuck axis. According to U.S. Pat. No. 3,720,382 the thread path between the rolls is to be laid out horizontally. According to U.S. Pat. No. 3,279,711, U.S. Pat. No. 2,869,796 and U.S. Pat. No. 3,844,496 both rolls are arranged at right angles with respect to the chuck axis. Other systems (e.g. according to U.S. Pat. No. 3,036,784 or CH 273678, or U.S. Pat. No. 4,351,492, or U.S. Pat. No. 4,566,643) have not been described or shown completely and thus their actual arrangements can only be speculated on.

SUMMARY OF THE INVENTION

It is the goal of the present invention to create an arrangement which permits achievement of a low design height level and correspondingly facilitated operation and at the same time permits application of the 90°-winding method under technologically favorable conditions (thread path geometry).

An apparatus according to the present invention in a first aspect comprises a roll arranged above the winder, the roll being provided with a rotatable thread guiding outer surface. The winder is laid out for building a plurality of thread packages simultaneously, and the apparatus is arranged in such a manner that it can supply a plurality of threads to the winder. The length of the outer surface and/or the distance between this surface and the winder chuck according to the present invention are to be chosen such that during the threading-in process the roll as well as the winder can be operated by only one operator. The roll in this arrangement is to be formed in such a manner that the threads can be distributed along the surface, namely in such a manner that no deflection angles, or deflection angle differences respectively, exceed 15°. Preferably, the operator is not required to climb any stairs, scaffold stages or similar auxiliary means. To achieve this goal, the design height level can be limited to 220 cm.

In a second aspect the present invention provides an apparatus for application in a spinning position with a roll and a support member. The support member is laid out in such a manner that at both ends of the roll a rotatable bearing can be provided. The support member is provided with fixing means permitting mounting of the whole apparatus as a unit onto the spinning position, the unit consisting of the roll and the support member being arranged cantilevered on the fixing means from where it protrudes. An apparatus according to the second aspect of the present invention is well suited for application in an apparatus according to the first aspect of the present invention.

The apparatus preferentially also comprises a triangulating thread guide, also called a head thread guide, for each thread. The distance between this thread guide and the contacting point on the corresponding thread package preferably range from three to four times the width of the traversing stroke. In winding a plurality of threads the head thread guides form a row normally extending horizontally. The roll can be arranged as close as possible to this row, the distance between the roll and the thread guide being influenced in most cases by further considerations, e.g. by the requirement of providing further elements in, or at, the thread path in the vicinity of the roll. If e.g. elements, such as interlacing nozzles, are to be acted upon between two parallel rolls, the provision of an increased distance between the last roll and the thread guide may prove necessary in order to make possible an arrangement of the additional elements within reach of the operator (e.g. below the roll).

The winder preferentially is equipped with at least two chucks which alternatingly are moved between a predetermined winding position and a readiness position, or doffing, position respectively. All threads of the spinning position thus can be wound simultaneously into thread packages on one single chuck. In order to wind the many threads on one spinning position into thread packages with the largest possible stroke width the chuck length can exceed 800 mm.

In this arrangement, (take-in) thread guides can be provided which distribute the threads along he first (take-in) roll. The length of the first roll can be chosen such that in thread passages between the first and the second roll no deflection angle differences exceeding 15° occur.

BRIEF DESCRIPTION OF THE DRAWINGS

Embodiments according to the present invention are described in more detail in the following with reference to illustrated examples. It is shown in:

FIG. 1 a schematic side view of a spinning apparatus from the spinneret to the winder, FIG. 2 a schematic view straight angles to FIG. 1 showing the thread path between the second roll and the winder.

DESCRIPTION OF PREFERRED EMBODIMENTS

Figure 3:
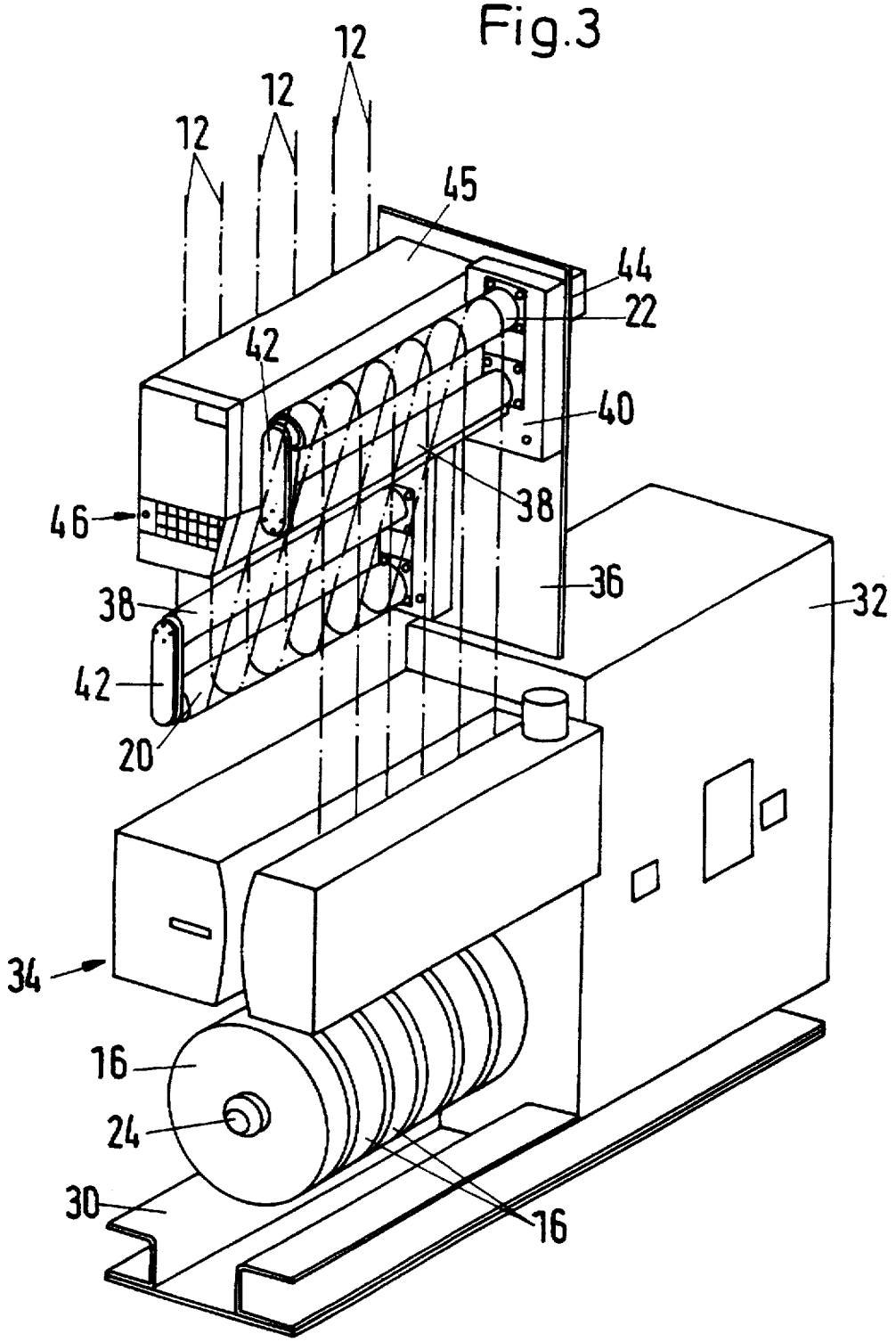
FIG. 3 a schematic isometric view of an apparatus according to the present invention.

FIG. 1 shows the spinneret beam 10 of a plant for spinning threads 12 (one thread 12 visible in FIG. 1) of synthetic filaments 14. The threads 12 are wound into thread packages 16 each on a winder 18 placed on a floor 15. The thread packages are wound onto a tube (not shown) placed onto a winder chuck 24. The chuck is supported for rotation about its own longitudinal axis in the winder 18. The thread within the winder 18 passes via a traversing device 17 and about a contact roll 19 before reaching the thread package 16. These elements are known as such, e.g. from EP-C-182389 and are not described further herein.

As explained in the aforementioned technical article by Ms. Fourne and Mr. Czase and Mears, it corresponds to conventional practice to apply two rolls 20, 22 for separating the spinning tension from the winding tension in the thread. A roll 20 is arranged below the spinneret beam 10 and the other roll 22 is arranged above the winder chuck 24.

The winder 18 and the pair of rolls 20, 22 together can be considered as an apparatus. This apparatus determines a "spinning position" on which up to eight threads can be processed simultaneously, a row of spinnerets in the spinneret beam 10 being part also of the apparatus. The present invention is of particular importance where a plurality of threads is being spun simultaneously and processed on a spinning position. The apparatus is laid out to a predetermined design height level BH above the floor 15 which in practical application is determined by the height position of the roll 22 above the floor 15.

In FIG. 2 the roll 22 above the winder is shown as well as four threads 12A,B,C,D ("four thread spinning position") and the corresponding thread packages 16A,B, C and D. The height position of the packages above the floor 15 (not designated) is determined by the design of the winder 18 and can not be influenced substantially. In the arrangement according to FIG. 2 a conventional roll 22 is shown, of relatively short length compared to the length of the winder chuck supporting the thread packages 16A through D. In this FIG. 2 also the so-called "winding triangles" are shown. The top corner of each triangle is formed by the corresponding head thread guide 26A through D (also called triangulation thread guide). The base line of the triangle corresponds to the traversing stroke of the winder (FIG. 2 showing a schematic view only with the traversing devices and possible thread deflecting devices being omitted). According to the common present state of the art, the height h of the winding triangle is chosen at 3 to 5 times the width L of the traversing stroke (i.e. the axial length of the thread package) and thus is determined by the desired dimensions of the thread package.

The design height level BH to a still greater extent is influenced by the distance H required between the thread guides 26A,B,C,D and the roll 22. The minimum distance H is determined by the so-called "deflection angle" $\alpha$ enclosed between the thread path from the roll 22 to the thread guide 26 and an vertical line S imagined through the thread guide 26.

The angles $\alpha$ are to be as equal as possible for all the threads processed on the spinning position. Differences in the angles $\alpha$ result in differences in the wrapping angles on the thread guiding elements, differing friction forces and thread tensions thus being generated. Such differences between the threads as well as between the thread packages formed therefrom (differences in the thread package build) result in quality differences. In a group of threads of e.g. eight threads today it is common practice to provide deflection angles between 3° (as a minimum) and 15° (as a maximum).

If a relatively short roll 22 is used from which the threads spread "ray-like" downward, the minimum value for the height H is determined by the "geometry" of the arrangement, in particular by the length of the chuck 24 and by the maximum deflection angle $\alpha A$ (where $\alpha A$ equals $\alpha D$ if the thread paths are arranged symmetrically). The overall design height BH level mainly is influenced by the height H and the minimum design height level according to arrangements currently in practical use does not permit threading-in by an operator from the floor 15—auxiliary means such as stair steps or a scaffold stages thus are to be provided.

If a longer roll 22 is chosen, the geometry of the required thread paths can be maintained and at the same time the height H can be reduced, as indicated schematically in FIG. 2 by the roll 22A shown in dashed lines. In principle a long roll 22 can be installed just above the thread guides 26.

In FIG. 3 again the winder 18 is shown with a base part 30, a drive head 32, a chuck 24 shown with built-up thread packages (in this case six threads are processed on the spinning position) and a carriage 34 comprising and supporting working elements such as a tacho-roll (19, FIG. 1) and traversing mechanisms (17, FIG. 1). The winder 18 in this case is a "revolver automatic winder" e.g. according to the international patent application WO 93/17948, FIG. 1, and FIG. 8 respectively. The second chuck in FIG. 3 is shown in its operating position, or winding position respectively, in which new thread packages are built. Neither this second chuck nor the thread packages it supports thus are visible in FIG. 3. The chuck 24 is shown in its doffing position, in which the thread packages 16 can be doffed and new tubes can be donned.

The winder 18 represents an assembly of the spinning position, or of the apparatus respectively. The rolls 20, 22 and their support members 36 form a second assembly of the same spinning position. This second unit comprises two roll arrangements, which can be designed identically, the description of one arrangement with the roll 22 above the chuck 24 being sufficient as an example.

The last-mentioned unit comprises the roll 22, a support tube 38, a base plate 40 and an end plate 42. The base plate and the end plate 42 are each equipped with a rotary bearing (not shown in FIG. 3) for the roll 22, the whole unit being arranged cantilevered and mounted onto the front side of the support member 36, protruding parallel to the chuck 24. The base plate 40 is provided with fixation means (not shown in FIG. 3) for attachment of the unit to the front side of the support member 36. The unit also comprises a motor 44 mounted onto the back side of the support member 36. The shaft of the motor is connected to the roll 22, e.g. in a manner described with reference to FIGS. 4 and 5.

The second unit comprises also an operating and control unit (also called control panel) 46, which also is mounted on the front side of the support member 36 between the threads passing towards the roll 20 and the threads passing towards the roll 22. The unit is connected via a plurality of wires (not shown) with frequency converters supplying the drive motors with electrical current. The motors 44 are laid out as frequency-controlled variable speed motors in such a manner that the rotational speed of the rolls can be determined by setting the output frequency of the corresponding converters. The rotational speed of the rolls thus can be adapted to the thread supply speed, and to the rotational speed of the chuck. The converters are not shown in the Figures—they may be located in a suitable cabinet.

The thread paths 12 extend mutually parallel from the intake of the apparatus through to the winder 18. For this purpose the rolls 20, 22 are of the same length as the chuck 24. The design height BH level (FIG. 1) from the floor 15 to the roll 22 thus can be chosen independently of the geometry of the thread paths as this arrangement does not require any differences of the deflection angles $\alpha$ (FIG. 2). A modification of the embodiment will be explained in the following with reference to the FIGS. 7 and 8.

Unheated rolls similar to the ones used as contacting rolls 19 (FIG. 1) in the winder can be used also as rolls 20, 22.

Figure 4:
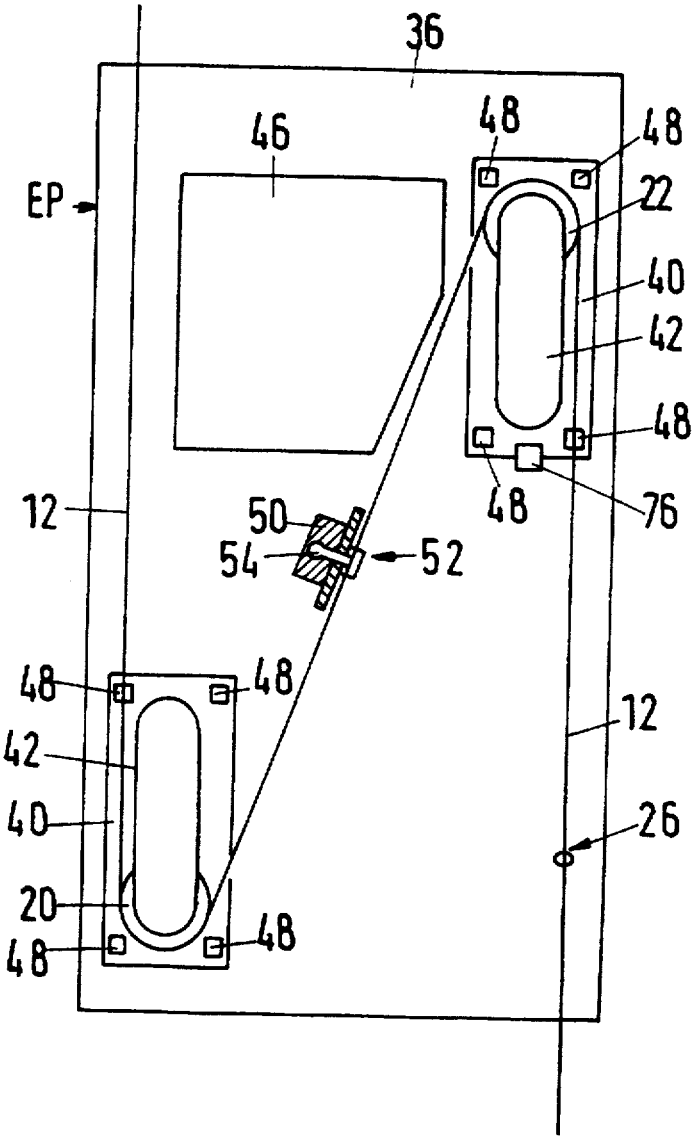
FIG. 4 a front view of an apparatus according to the present invention.
Figure 5:
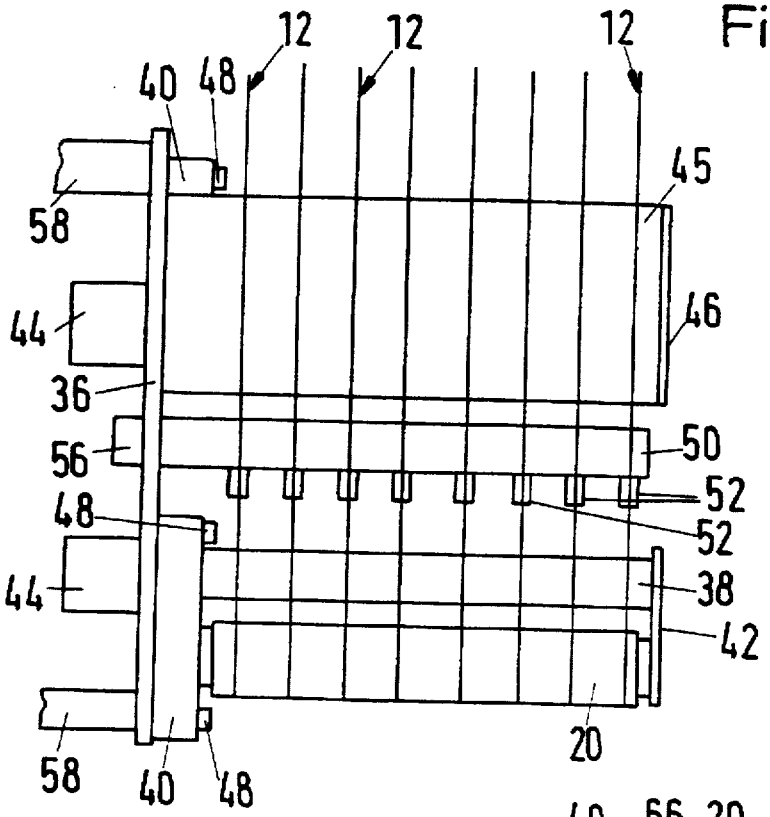
FIG. 5 a side view of an assembly of the apparatus according to FIG. 4.

In FIGS. 4 and 5 a further embodiment of a spinning position processing eight threads is shown. The thread paths 12 are indicated but not described in more detail as they are arranged similarly as the ones shown in FIG. 3. The fixation means 48 for mounting the base plates 40 are shown in FIGS. 4 and 5. They can be provided with elastic elements in order to eliminate, or reduce respectively, transmission of vibrations to the support member 36. Below the control panel 46 a beam 50 also is mounted onto the support member. The beam 50 extends parallel to the rolls 20, 22 and supports interlacing vortex nozzles 52 each coordinated to one of the threads 12. Air supply for these vortex nozzles is effected via a longitudinal duct 54 (FIG. 4) connected with an air coupling 56 (FIG. 5) provided at the back side of the support member 36.

Figure 6:
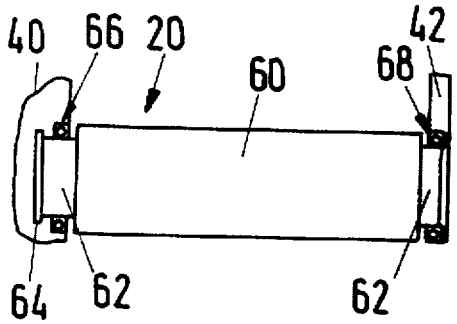
FIG. 6 a detail of the roll according to FIG. 5.

The motors 44 also are indicated in FIG. 5. Each base plate 40 contains a hollow room (not indicated) in which a cogged belt or power grip belt transmission (not shown) is provided each between the motor shaft and a cogged wheel (not shown) on the corresponding roll 20, and 22 respectively. In FIG. 6, e.g. the roll 20 is shown comprising the following elements:

- a roll-shaped body 60 with a cylindrical outer surface (not specially designated),
- a shaft 62 with the aforementioned cogged wheel,
- a first rotary bearing 66 at the inner end of the roll and a second rotary bearing 68 at the outer end of the roll.

The body 60 is rigidly mounted onto the shaft in such a manner that it rotates together with the shaft about the longitudinal axis of the shaft. The outer surface forms the thread guide surface of the roll. The bearing 66 is supported by the base plate 40 and the bearing 68 is supported by the end plate 42. One single motor could be provided with a transmission for both rolls. A design layout in which providing each of the two rolls is provided with its own motor (individual drive) presents the advantage that the thread tension easily can be adapted by changing the relative speeds of the rolls. This adaptation otherwise would have to be effected by the transmission.

Figure 7:
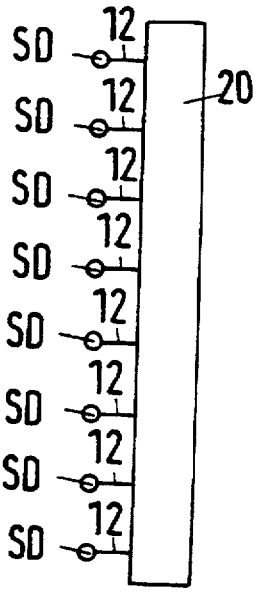
FIG. 7 a top view of a first embodiment of the row of spinnerets in relation to the rolls.
Figure 8:
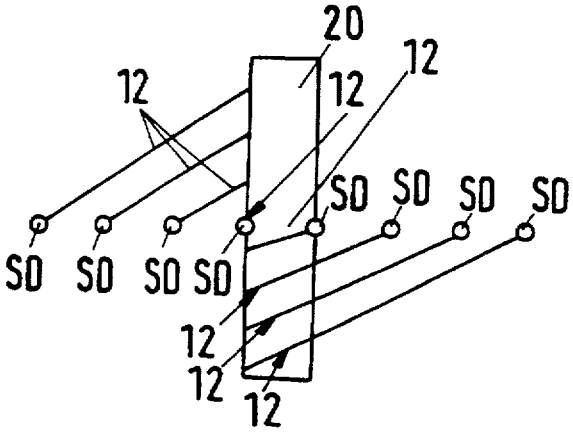
FIG. 8 a top view of a second embodiment of the row of spinnerets in relation to the rolls.

The support member 36 can be mounted as a "diaphragm" in the apparatus. In FIG. 5 two main support members 58 are shown schematically connected with the support diaphragm 36. The arrangement of the rolls with respect to the spinnerets of the spinneret beam 10 (FIG. 1) can be adapted to the requirements as described briefly with reference to FIGS. 7 and 8. In FIG. 7 the spinnerets of a spinning position processing eight threads are shown. In this arrangement the spinnerets are arranged in one row parallel to the roll 20 (or to the roll 22 respectively). The spinnerets designated SD also and the roll designated 20 are indicated in FIG. 8. In this arrangement, however, the row of spinnerets is arranged at right angles with respect to the roll. Each thread path is designated with the reference number 12. For the same gage and the same spinneret size SD the roll 20 (and thus also the roll 22) can be designed shorter in the arrangement according to FIG. 8 than the roll 20 (and 22 respectively) in the arrangement according to FIG. 7. In the latter case the length of each roll can be chosen about equal to the length of the chuck 24. The length of the rolls is determined on one hand by the operating height level envisaged and on the other hand by the admissible deflection angles. The roll 20 also can be designed shorter than the roll 22.

Figure 9:
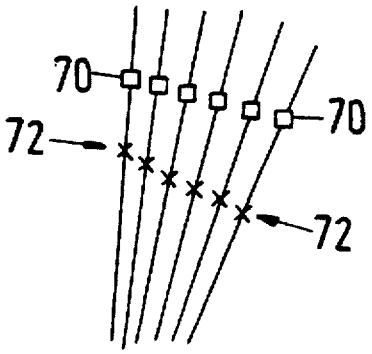
FIG. 9 a schematic isometric view of the take-in zone of an apparatus according to FIG. 4, an embodiment according to FIG. 8 being applied.

The arrangement according to FIG. 8 requires a corresponding lay-out of the take-in zone of the apparatus, i.e. of the zone EP in FIG. 4. As the thread paths 12 in this case are not coplanar, the locations of the conventional thread cutting devices 70 and of the thread suction nozzles 72 (FIG. 9) are to be adapted to the thread paths. The suction tubes (not shown) coordinated to the suction nozzles 72 are located in the box 45 behind the control panel 46. The devices 70 and the nozzles 72 become operative in case of a thread breakage. Thread guides (not shown) can be provided above the first roll unit (containing the roll 20).

Figure 10:
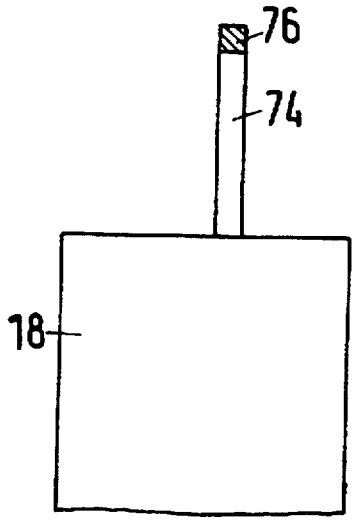
FIG. 10 a detail explaining the arrangement of the head thread guides.

In FIG. 10 a support arm 74 and a beam 76 for the head thread guides 26 (FIG. 2) are shown. The arm 74 is mounted on the winder 18, the position of the thread guide 26 also being indicated in FIG. 4 (opposite the support member 36). In the case of an arrangement according to FIG. 8 it may prove advantageous to provide, below the support tube 38 of the roll 22, a beam 76 (FIG. 4) supporting further thread guides (not shown) in order to determine the thread path from the roll 22 into the thread guide 26. It is not necessarily required that a deflection angle of 0° be striven for. If larger deflection angles (below the limit of 15°) are permitted, reductions of the design height level can also be achieved according to the invention. The following dimensions are mentioned merely in the sense of an example without restricting the patent claims:

1) Height level of the axis of the roll 20 above the floor about 1360 mm e.g. 1200 to 1400 mm
2) Height level of the axis of the roll 22 above the floor about 2100 mm e.g. 2000 to 2200 mm
3) Horizontal distance between the roll axes about 300 mm e.g. 250 to 350 mm.

A spinneret beam suitable for application in a plant according to the present invention is described in the PCT patent application No. PCT/IB94/00123 under the date of application of Sep. 7, 1994. A spinneret unit suitable for application in the same plant is described in the PCT patent application PCT/CH94/00123 under the date of application of Jun. 20, 1994. The plant in particular is suitable for producing POY-threads (of polyester or polyamid).

Provision of a support tube 38 could be dispensed with if each of the rolls 20, 22 is designed stiffer, which normally can be achieved if a larger roll diameter is chosen. Structural strength being sufficient, any roll can be supported in a cantilever arrangement mounted onto the support member 36. In this arrangement, however, it is not possible to design the rolls and the contacting roll of the winder identically.

The thread paths within an apparatus according to FIG. 3 are determined by the position of the thread guides (take-in thread guides as well as head thread guides) relative to the rolls and thus are given by the design of the apparatus. Within the apparatus thus it is possible to provide parallel thread paths. The height level of the incoming thread on the thread packages according to the design of the apparatus also is given in relation to the head thread guide. It thus is possible, within predetermined limits to treat the threads "equally". However, it is not possible to determine the conditions in the take-in zone beforehand, which will be described in the following with reference to the FIGS. 11 and 12.

Figure 11:
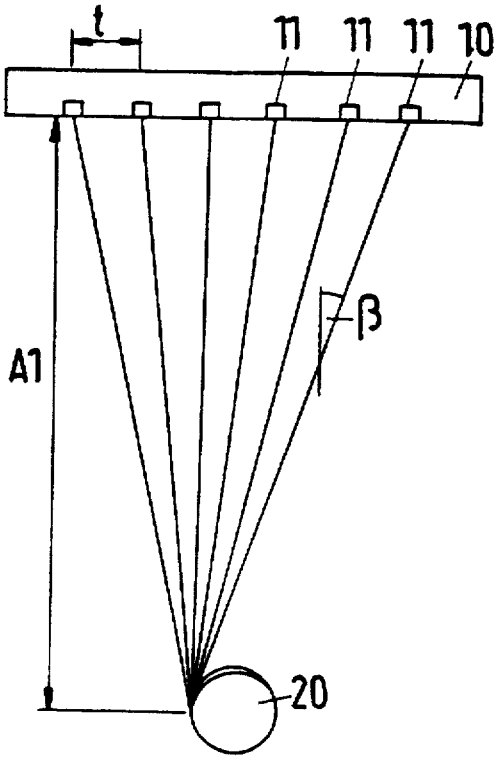
FIG. 11 and FIG. 12 a schematic view of an alternative embodiment of the so-called "90° winding method", with different take-in angles being applied.
Figure 12:
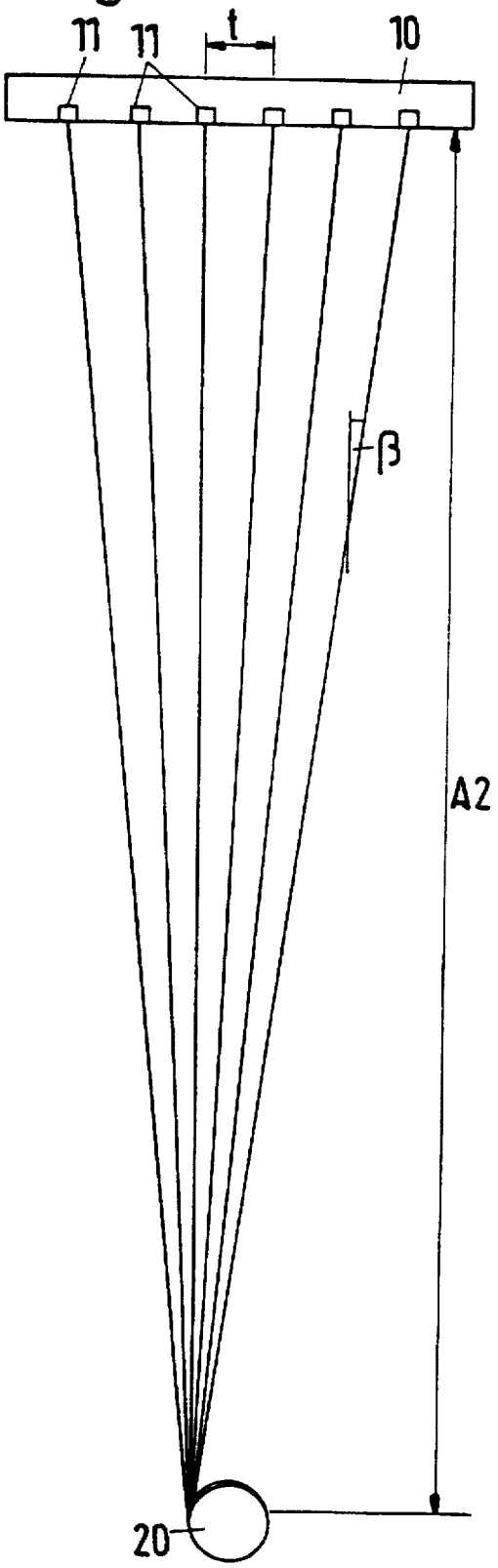

In FIGS. 11 and 12 the take-in rolls 20 of the take-in zone are shown of an apparatus according to the present invention e.g. according to FIG. 3. The rolls 20 are of the same length (not shown in these Figures). These devices each are coordinated to a beam 10, each of the beams 10 being provided with a row of six spinneret units 11. The spinneret gage t in both cases is the same, the distance $A_2$ between the spinneret units 11 and the roll 20 in FIG. 12, however being markedly greater than the corresponding distance $A_1$ in FIG. 11.

The "group of threads" is indicated schematically only by lines in FIG. 11 as well as in FIG. 12 without considering the collection process of the individual fibrils (comp. FIG. 1). This is admissible as based on these Figures the conditions in the take-in zones, where the individual filaments already are bundled into threads, are to be discussed for both cases. The threads are equally distributed along the rolls 20. From the FIGS. 11 and 12 it can be seen immediately that the take-in geometry (particularly the take-in angles β) depend on the distance $A_1$, and on the distance $A_2$ respectively. Thus the suction nozzles and the cutting devices 70, 72 (FIG. 9, in FIGS. 11 and 12 not shown) should be arranged adjustably in such a manner that their position can be adapted to the conditions prevailing.

In a preferred embodiment of the apparatus the suction nozzles and the cutting devices 70, 72 are grouped in a unit together with the thread guides determining the distribution of the threads along the roll 20. This causes a problem in that the position of the take-in thread guides also would be changed if the position of the suction nozzles and of the cutting devices 70, 72 is adapted, which is undesirable as said thread guides also determine the geometry of the thread paths within the apparatus. A solution to this problem is explained in the following with reference to the FIGS. 1 through 15.

Figure 13:
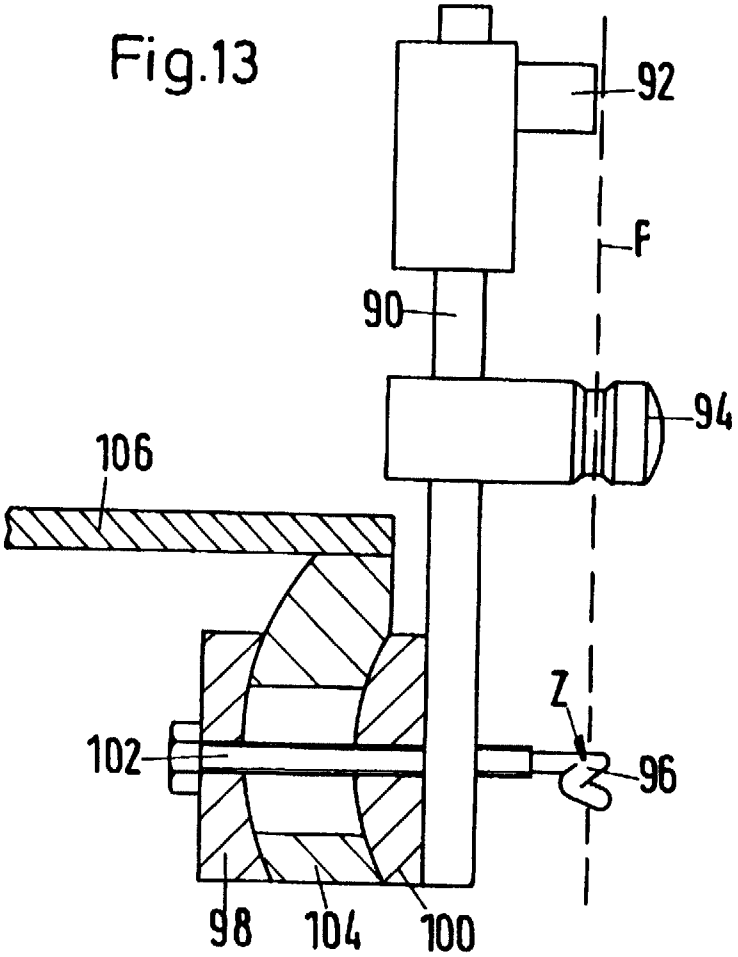
FIG. 13 an assembly in the take-in zone of an apparatus according to the present invention.

In FIG. 13 a support rod 90 is shown with a suction device 92, a cutting device 94 and a thread guide 96 in the form of an eyelet. The devices 92, and 94 respectively are of conventional design and they are mounted using suitable means (not shown) onto the rod 90 at a predetermined distance in such a manner that they occupy predetermined positions relative to a vertical thread path F, if the rod 90 also is arranged vertically. This is e.g. the case if the apparatus is used for the parallel winding method.

Figure 14:
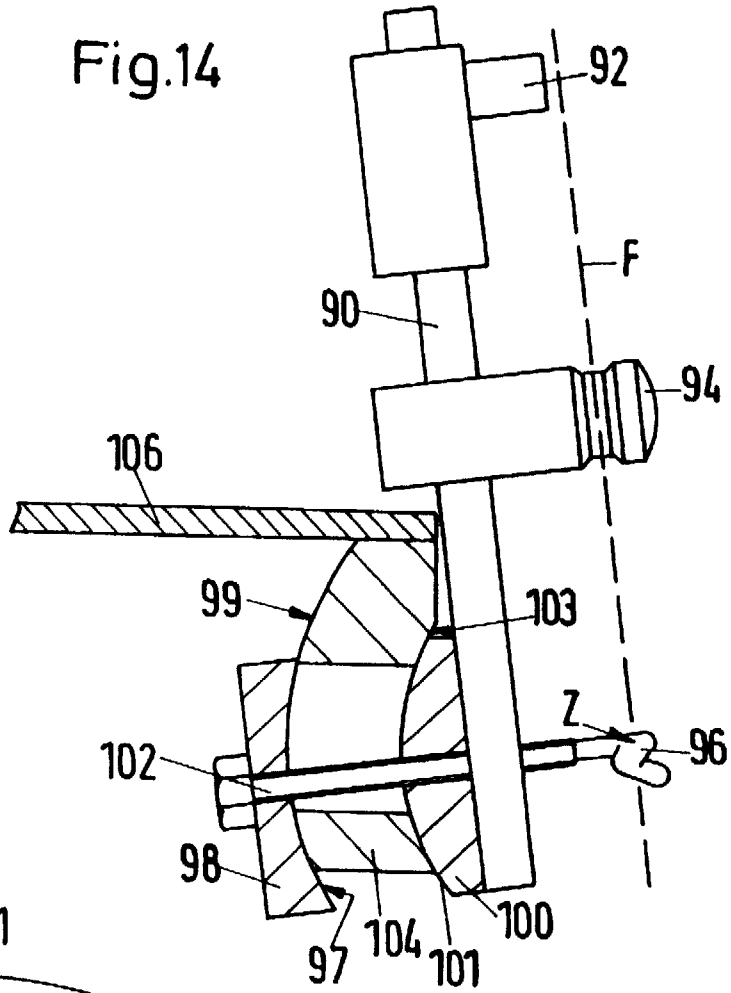
FIG. 14 the assembly according to FIG. 13 in a changed position.
Figure 15:
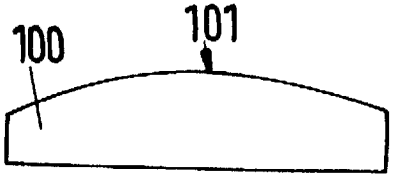
FIG. 15 a detail of the assembly according to FIGS. 13 and 14.

The rod 90 now also can be tilted from its vertical position in order to adapt (within predetermined limits) the inclination of the thread path F if the 90° winding method is applied (see FIG. 14). The devices 92, 94 then occupy positions relative to the new thread path corresponding to the ones according to FIG. 13. The eyelet 96 in both cases maintains its predetermined position relative to the room. This is rendered possible as the rod 90 by means of clamping elements 98, 100 and of a bolt 102 are mounted to a "cup" 104 which in turn is rigidly mounted to a part 106 of the frame of the apparatus. The elements 98, 104 comprise surfaces 97, 99 (FIG. 14) which are located on a first imaginary sphere and the elements 100, 104 comprise surfaces 101, 103 which are located on a second imaginary sphere (see also FIG. 15, where the element 101 is shown seen from above). The "centre" Z of the eyelet 96 (i.e. the point where the thread path F intersects the plane of the eyelet) forms the centre of both imaginary spheres.

Adaptability is limited by the size of the "spherical" surfaces. A maximum inclination of e.g. up to 10° relative to the vertical position can be chosen. It would be possible to merely arrange the devices 92, 94 on the adaptable rod 90, and to rigidly mount the thread guide 96 separately. The embodiment shown, however, ensures that the desired mutual relations between the devices 92, 94 and the thread guide 96 are maintained, which otherwise would have to be set every time separately (and with the corresponding danger of errors in settings or of displacement).

Figure 16:
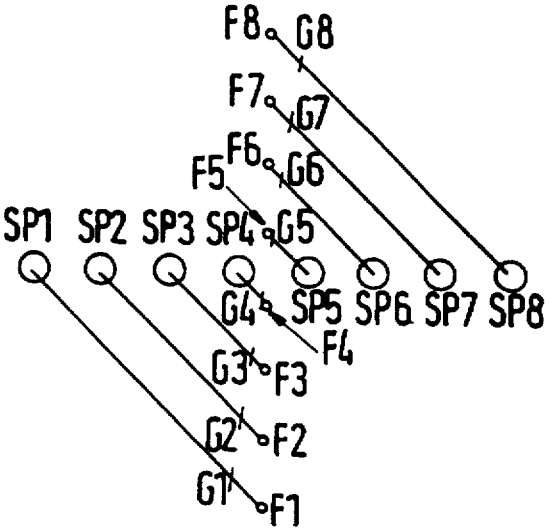
FIG. 16 a view similar to the one shown in FIG. 8 but with an assembly according to the FIGS. 13 through 15, and in FIG. 17 a view of an apparatus according to the present invention.

For each thread a separate support rod 90 is provided with the device, and the thread guide respectively are provided in such a manner that the settings can be chosen individually in function of the actual processing conditions. This permits e.g. an arrangement according to FIG. 16, in a spinning position processing eight threads, wherein the spinnerets are designated SP1 through SP8, the thread guides F1 through F8, and the suction nozzles/cutting devices G1 through G8. The thread paths are, similarly as in the FIGS. 8, 11 and 12, also are indicated schematically merely.

Figure 17:
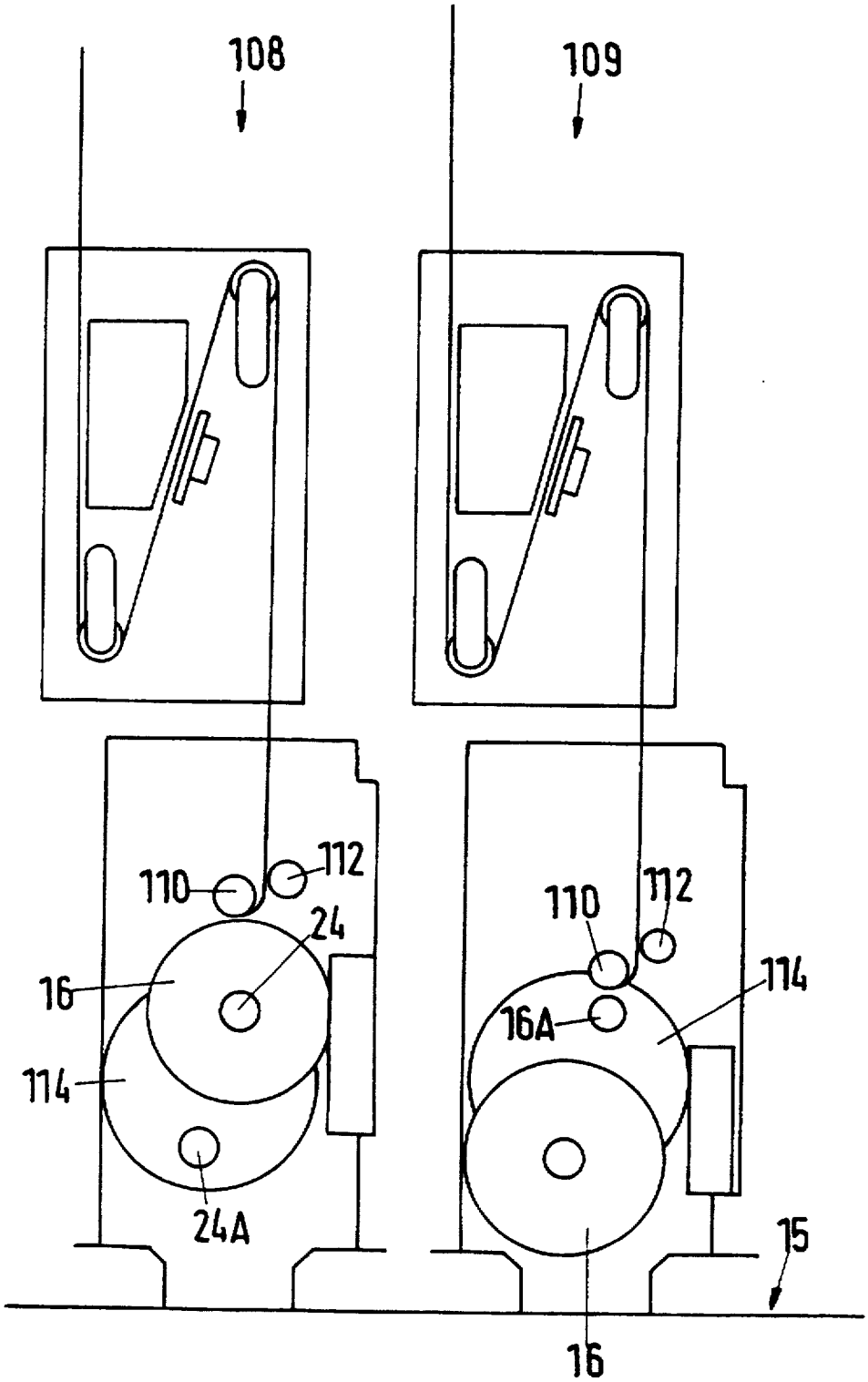

In FIG. 17 two adjacent apparatuses 108, 109 are shown (similar to the one shown in FIG. 3) in a front view, the carriages 34 (FIG. 3) being omitted in FIG. 17 in order to render visible the contacting rolls 110 and the traversing devices 112 supported thereon. In the apparatus 109 a thread package change just has been completed in such a manner that the completed thread packages 16 are located in the doffing position and the contacting roll 110 contacts the windings of a newly started thread package 16A. In the apparatus 108 a thread package change is coming up, the contacting roll 110 still being in contact with the almost completed thread package 16 and the thread package tubes (not indicated in particular) on the second chuck 24A still located in the doffing position or readiness position. As the revolver rotates, the two chucks 24, 24A mutually exchange their positions.

The overall length of the thread path between the take-in thread guide and the thread deposition point on the thread package (the contact zone of the contacting roll on the thread package) thus varies over the thread package build. The variation, however, is equal for all threads and occurs simultaneously for all threads of the spinning position. The processing conditions thus are maintained (within the limits imposed by the geometry of the thread paths) equal for all threads at all times.

What is claimed is:

1. Apparatus for advancing and winding endless filamentary threads comprising a floor upon which a person may stand while attending to the threads; a winding machine including a chuck rotatably mounted above said floor and having a length sufficient for the winding thereon of multiple coaxial cylindrical thread packages spaced apart from one another lengthwise of said chuck; means for rotating said chuck; a driven thread advancing roll above said winder chuck less than 2500 mm above said floor so that a single person standing on said floor can attend to the threading-in of both said roll and said winding machine; and a plurality of stationary thread guides between said thread advancing roll and said chuck, said thread guides being arranged in a row parallel to said chuck with each of said thread guides being positioned above a location where a corresponding one of said thread packages is to be wound, and said thread advancing roll being long enough and being spaced far enough above said thread guides to allow each of the threads to pass from a surface portion of said roll to a respective thread guide along a path having an inclination of less than about 15 degrees relative to a vertical axis through the thread guide to prevent unacceptable tension differences between the threads of said plurality of threads.

2. Apparatus according to claim 1, including a traverse mechanism for imparting a traversing stroke to each of said threads, and wherein the distance between said thread guides and the chuck is three to five times the width of the traversing stroke.

3. Apparatus according to claim 1, wherein said advancing roll is substantially parallel to said chuck and has a length substantially equal to the length of said chuck.

4. Apparatus according to claim 1, including a row of spinnerets above the level of said thread advancing roll through which the filaments issue; a second driven thread advancing roll extending substantially parallel to said row of spinnerets to frictionally engage the filaments; and drive means for said second thread advancing roll for causing said second thread advancing roll to pull the filaments passing from the spinnerets.

5. Apparatus according to claim 1, including bearings rotatably supporting opposite end portions of said thread advancing roll and means for supporting said bearings to minimize deflection of said roll in response to tension in the threads.

6. Apparatus according to claim 1, including a stationary support member; an elongated support having an end portion rigidly connected to said support member, said elongated support extending substantially parallel to said chuck and having an opposite end portion spaced from said support member; a thread advancing roll having an end portion thereof rotatably mounted on said support member, extending substantially parallel to said elongated support, and having an opposite end portion spaced from said support member; and means rigidly connected to said opposite end portion of said elongated support and rotatably supporting said opposite end portion of said advancing roll to brace said roll against deflection when substantial forces are applied to said roll as a result of tension in the threads.

7. Apparatus according to claim 1, additionally including a separate thread guide for each of the threads upstream of said thread advancing roll and a thread catcher connected with a respective one of the last mentioned thread guides as a unit to catch broken threads.

8. Apparatus according to claim 7, including means for mounting each of said units so that the position of its catcher can be varied without changing the position of its thread guide.

9. Apparatus according to claim 7, additionally including a row of spinnerets upstream of said units.

* * * * *